US011801196B1

(12) United States Patent
Liu et al.

(10) Patent No.: US 11,801,196 B1
(45) Date of Patent: Oct. 31, 2023

(54) MASSAGING DEVICE

(71) Applicant: HYTTO PTE. LTD., Singapore (SG)

(72) Inventors: Dan Liu, Guangzhou (CN); Jilin Qiu, Guangzhou (CN)

(73) Assignee: HYTTO PTE. LTD., Singapore (SG)

( * ) Notice: Subject to any disclaimer, the term of this patent is extended or adjusted under 35 U.S.C. 154(b) by 0 days.

(21) Appl. No.: 17/870,767

(22) Filed: Jul. 21, 2022

(51) Int. Cl.
*A61H 19/00* (2006.01)

(52) U.S. Cl.
CPC ..... *A61H 19/34* (2013.01); *A61H 19/44* (2013.01); *A61H 2201/5035* (2013.01)

(58) Field of Classification Search
CPC ..... A61H 19/00; A61H 19/30; A61H 19/34; A61H 19/40; A61H 19/44; A61H 19/32; A61H 21/00; A61H 19/50; A61H 2201/1215; A61H 23/00
See application file for complete search history.

(56) References Cited

U.S. PATENT DOCUMENTS

| | | | |
|---|---|---|---|
| 8,409,120 | B2 | 4/2013 | Knyrim |
| 9,737,458 | B1 | 8/2017 | Olivares et al. |
| 10,959,907 | B2 | 3/2021 | Haddock et al. |
| 11,071,681 | B2 | 7/2021 | Sedic |
| 11,382,827 | B2 | 7/2022 | Topolev |
| 2012/0316390 | A1 | 12/2012 | Topolev |

*Primary Examiner* — Christine H Matthews
(74) *Attorney, Agent, or Firm* — Kanika Radhakrishnan; Evergreen Valley Law Group

(57) ABSTRACT

Embodiments of the present disclosure disclose a massaging device. The massaging device includes a first stimulating member and a second stimulating member. The second stimulating member includes a drive member. The drive member includes a first arm configured with a retainer member and a second arm. The retainer member is secured to a first limiting member of the first stimulating member to couple the first stimulating member and the second stimulating member. Further, the massaging device includes an actuator positioned in the second stimulating member and operatively coupled to the drive member. The actuator is configured to induce a rotary motion to the drive member for operating at least the first stimulating member and the second stimulating member in a plurality of stimulation modes. The first and second stimulating members operable in the plurality of stimulation modes induce sexual stimulation to the erogenous zones of a user.

19 Claims, 10 Drawing Sheets

MASSAGING DEVICE

TECHNICAL FIELD

The present disclosure relates to a massaging device and, more particularly relates, to the massaging device for providing sexual stimulation to genital organs.

BACKGROUND

Masturbation is generally referred to as a natural and safe way to explore one's body i.e. stimulation of genital organs to obtain sexual pleasure. Typically, people use conventional techniques for exploring one's body (irrespective of gender) to attain sexual pleasure. However, the conventional techniques are generally unhygienic and thus not desirable.

Sex toys are designed in a variety of configurations and perform a variety of functions, ranging from medical therapy to erotic stimulation. For example, the sex toys such as dildos are used by female users for masturbating. Such sex toys are generally phallic-shaped and are simpler to use for providing sexual pleasure to female users. Additionally, such sex toys include a vibration feature for enhancing sexual stimulation to female genital organs (e.g., vaginal area). However, the usage of sex toys in the genitals (e.g., vaginal area) for experiencing sexual stimulation can lead to irritations or inflammations of the skin near the genital organs (or the vaginal area). Further, the usage of these sex toys to provide sexual pleasure is fairly limited and is not designed specifically to accommodate the different physiologies (or arousals) of different users. Thus, such sex toys may not provide the desired and satisfactory sexual pleasure to the users.

Moreover, the sexual pleasure of female users generally depends on the stimulation of more than one erogenous region of the female genital organs. One such example is clitoral stimulation. Further, users generally may use devices that are configured to create a pressure difference (e.g., vacuum pumps) proximate to the clitoral region. However, such devices are relatively complex and result in an annoying or disturbing user experience. Furthermore, such devices (i.e. the vacuum pumps) are associated with valves or ventilation components that often have blind spots which are difficult to clean and thus hygiene-related issues.

Therefore, there is a need for a device with simple construction and use, for providing an effective stimulation effect to erogenous zones of genital organs of the users in order to overcome one or more limitations stated above in addition to providing other technical advantages.

SUMMARY

Various embodiments of the present disclosure provide a massaging device for inducing sexual stimulation to female genitalia or one or more erogenous zones of female users.

In an embodiment, a massaging device is disclosed. The massaging device includes a first stimulating member and a second stimulating member. The second stimulating member includes a drive member. The drive member includes a first arm configured with a retainer member and a second arm. The retainer member of the first arm is movably secured to a first limiting member configured in a distal portion of the first stimulating member, thereby enabling a coupling between the first stimulating member and the second stimulating member. Further, the massaging device includes an actuator positioned in the second stimulating member and operatively coupled to the drive member. The actuator is configured to induce a rotary motion to the drive member for operating at least the first stimulating member and the second stimulating member in a plurality of stimulation modes. The first stimulating member and the second stimulating member being in contact with one or more erogenous zones of a user and operable in the plurality of stimulation modes induce sexual stimulation to the one or more erogenous zones of the user.

In another embodiment, a massaging device for inducing sexual stimulation is disclosed. The massaging device includes a first stimulating member and a second stimulating member. The second stimulating member includes a drive member. The drive member includes a first arm configured with a retainer member and a second arm. Further, the retainer member of the first arm is movably secured to a first limiting member configured in a distal portion of the first stimulating member. Furthermore, the first limiting member is a guide groove structure adapted to receive the retainer member of the retainer member, thus enabling a coupling between the first stimulating member and the second stimulating member. The massaging device further includes an actuator positioned in the second stimulating member and operatively coupled to the drive member. The actuator is configured to induce a rotary motion to the drive member. Further, the rotary motion of the drive member allows the retainer member to traverse along at least a length of the first limiting member, thereby allowing at least the first stimulating member and the second stimulating member in a plurality of stimulation modes. The first stimulating member and the second stimulating member being in contact with one or more erogenous zones of a user and operable in the plurality of stimulation modes induce sexual stimulation to the one or more erogenous zones of the user.

BRIEF DESCRIPTION OF THE FIGURES

The following detailed description of illustrative embodiments is better understood when read in conjunction with the appended drawings. To illustrate the present disclosure, exemplary constructions of the disclosure are shown in the drawings. However, the present disclosure is not limited to a specific device, or a tool and instrumentalities disclosed herein. Moreover, those in the art will understand that the drawings are not to scale.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Various example embodiments of the present disclosure are described hereinafter with reference to FIG. 1 to FIGS. 5A-5C.

Figure 1:
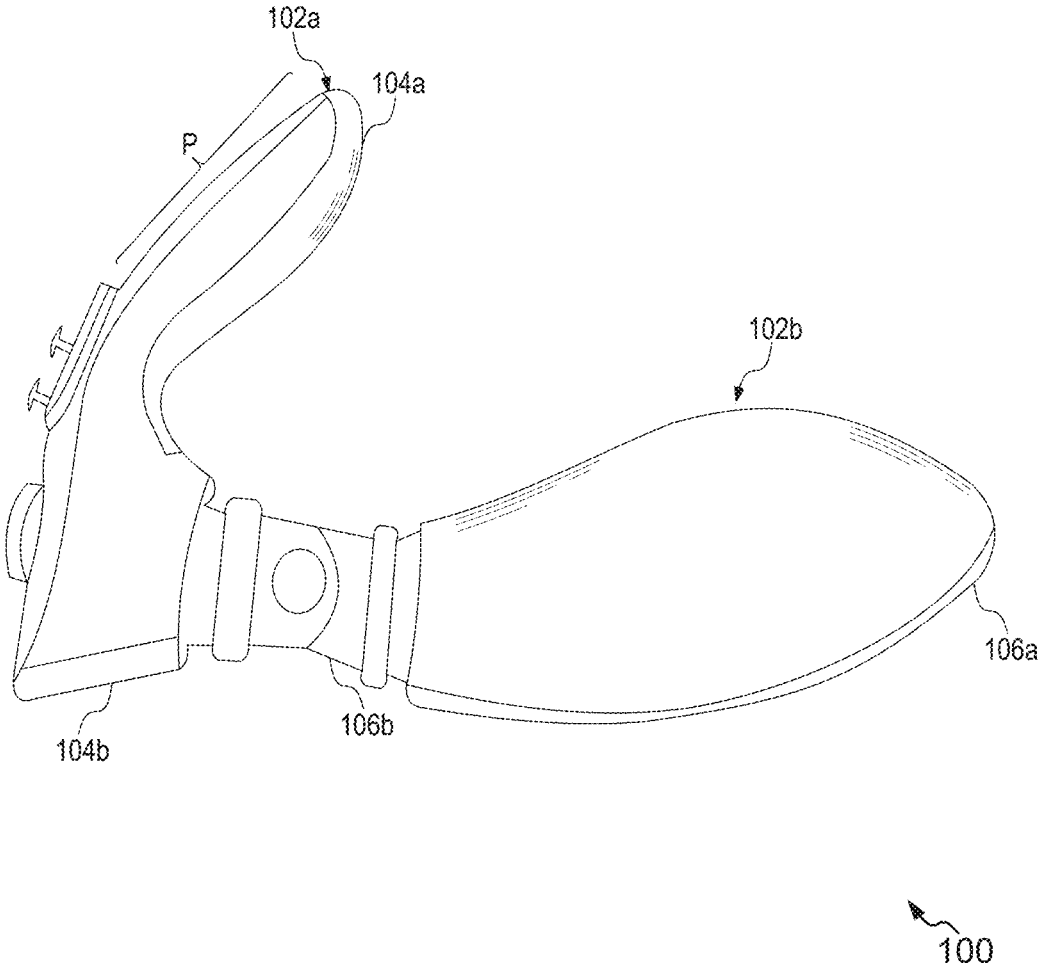
FIG. 1 illustrates a perspective view of a massaging device, in accordance with an embodiment of the present disclosure.

FIG. 1 illustrates a perspective view of a massaging device 100, in accordance with an embodiment of the present disclosure. The massaging device 100 is operated to provide sexual stimulation to the genital organs of users. As shown, the massaging device 100 may include at least one phallic shaft (or phallic-shaped configuration) for stimulating the genitals. Specifically, the massaging device 100 is configured with stimulating members for simultaneously stimulating one or more erogenous zones and/or the genital organs.

The massaging device 100 includes a first stimulating member 102*a* and a second stimulating member 102*b*. The first and second stimulating members 102*a* and 102*b* are coupled to each other via a coupling mechanism and form a substantially V-shaped configuration or a substantially L-shaped configuration. Further, such configuration of the massaging device 100 corresponds to a rabbit vibrator configuration. In one embodiment, the second stimulating member 102*b* and at least a portion of the first stimulating member 102*a* (represented by T') are substantially phallic-shaped (or an erectile penis). The first stimulating member 102*a* may be configured with a smaller cross-section of the similar configuration of the second stimulating member 102*b* or vice-versa as per the operability modes and/or requirements. As shown, the diameter of the cross-section of each of the first stimulating member 102*a* and the second stimulating member 102*b* varies across its length. Specifically, the first stimulating member 102*a* includes a proximal portion 104*a* and a distal portion 104*b* and the second stimulating member 102*b* includes a first portion 106*a* and a second portion 106*b*. The terminal ends of each of the proximal portion 104*a* and the first portion 106*a* may be configured to be substantially a tapered section or a dome structure. Further, the first and second stimulating members 102*a* and 102*b* are configured to be of an optimum length sufficient for suitably stimulating various erogenous regions and/or zones of the genitals which will be explained further in detail. In some embodiments, the first and second stimulating members 102*a* and 102*b* may include protrusions, ridges, bumps, dimples, or any other impressions for enhancing sexual pleasure.

The first and second stimulating members 102*a* and 102*b* may be configured with materials that are safe for use on human skin. For example, the first and second stimulating members 102*a* and 102*b* may be made of materials such as, but not limited to, porcelain, borosilicate, medical-grade silicone, and the like. In an embodiment, a sleeve made of silicone may be inserted onto each of the first stimulating member 102*a* and the second stimulating member 102*b* for providing a hassle-free experience to the user while in use. Further, the first stimulating member 102*a* and the second stimulating member 102*b* coupled to each other are oriented at a first threshold angle (see, angle '$\alpha_1$' of FIG. 4A).

Further, the massaging device 100 may include an actuator (see, 302) positioned in the second stimulating member 102*b*. The actuator (e.g., a motor) may be configured to operate at least the first stimulating member 102*a* and the second stimulating member 102*b* in a plurality of stimulating modes. Moreover, the angular orientation of the first stimulating member 102*a* relative to the second stimulating member 102*b* facilitates the actuator to operate at least the first stimulating member 102*a* and the second stimulating member 102*b* in the plurality of stimulating modes which will be explained further in detail. It is to be noted that the first and second stimulating members 102*a* and 102*b* operating in the plurality of stimulating modes facilitate the sexual stimulation of the erogenous zones of the user. In an example scenario, the massaging device 100 may be used by female users for stimulating one or more erogenous zones of the female genitalia. In particular, the first stimulating member 102*a* and the second stimulating member 102*b* may be operated for stimulating the one or more erogenous zones such as the clitoris, and vaginal area, respectively. Thus, the first stimulating member 102*a* corresponds to a clitoris stimulator and the second stimulating member 102*b* corresponds to a vaginal area stimulator based on their corresponding operability. As such, operating the first stimulating member 102*a* and the second stimulating member 102*b* of substantially phallic-shaped allows the female users to experience a satisfying masturbating experience. In another example, the massaging device 100 can be used as a prostate massager, or the like as per feasibility and requirement.

Figure 2:
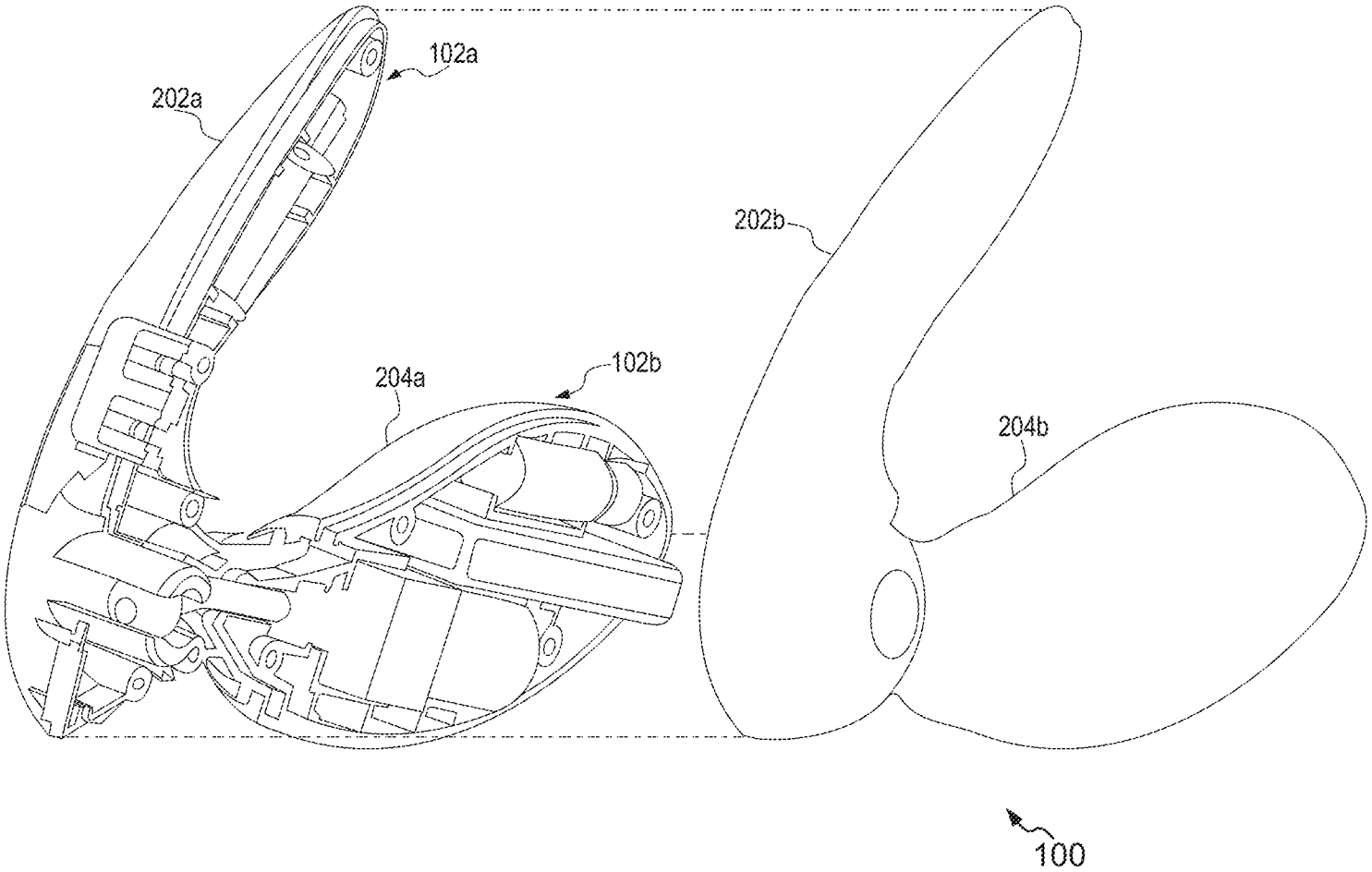
FIG. 2 illustrates an exploded view of the massaging device, depicting each half-shell of the massaging device, in accordance with an embodiment of the present disclosure.

Referring to FIG. 2, the first stimulating member 102*a* includes a first half-shell 202*a* and a second half-shell 202*b*. As shown, the first half-shell 202*a* and the second half-shell 202*b* are detachably coupled to each other via suitable coupling means such as screws, snap-fit arrangement, and so forth. Further, the second stimulating member 102*b* includes a third half-shell 204*a* and a fourth half-shell 204*b* detachably coupled to each other via suitable coupling means as explained above. The detachable coupling of the first half-shell 202*a* with the second half-shell 202*b*, and the third half-shell 204*a* with the fourth half-shell 204*b* allows access to the internal components of the massaging device 100. It is to be noted that the detachable coupling of the first and second stimulating members 102*a* and 102*b* form a decoupled structure of the massaging device 100. The decoupled structure of the massaging device 100 provides access to the internal components of the massaging device 100 in case of repair or replacement of any of the internal components housed within the first and second stimulating members 102*a* and 102*b*.

In an embodiment, the first and second stimulating members 102*a* and 102*b* may be a unitary structure. In this configuration, the distal portion 104*b* of the first stimulating member 102*a* may be configured with flexible materials of optimum strength such that the first and second stimulating members 102*a* and 102*b* are capable of operating in the plurality of stimulating modes without any intervention.

Figure 3:
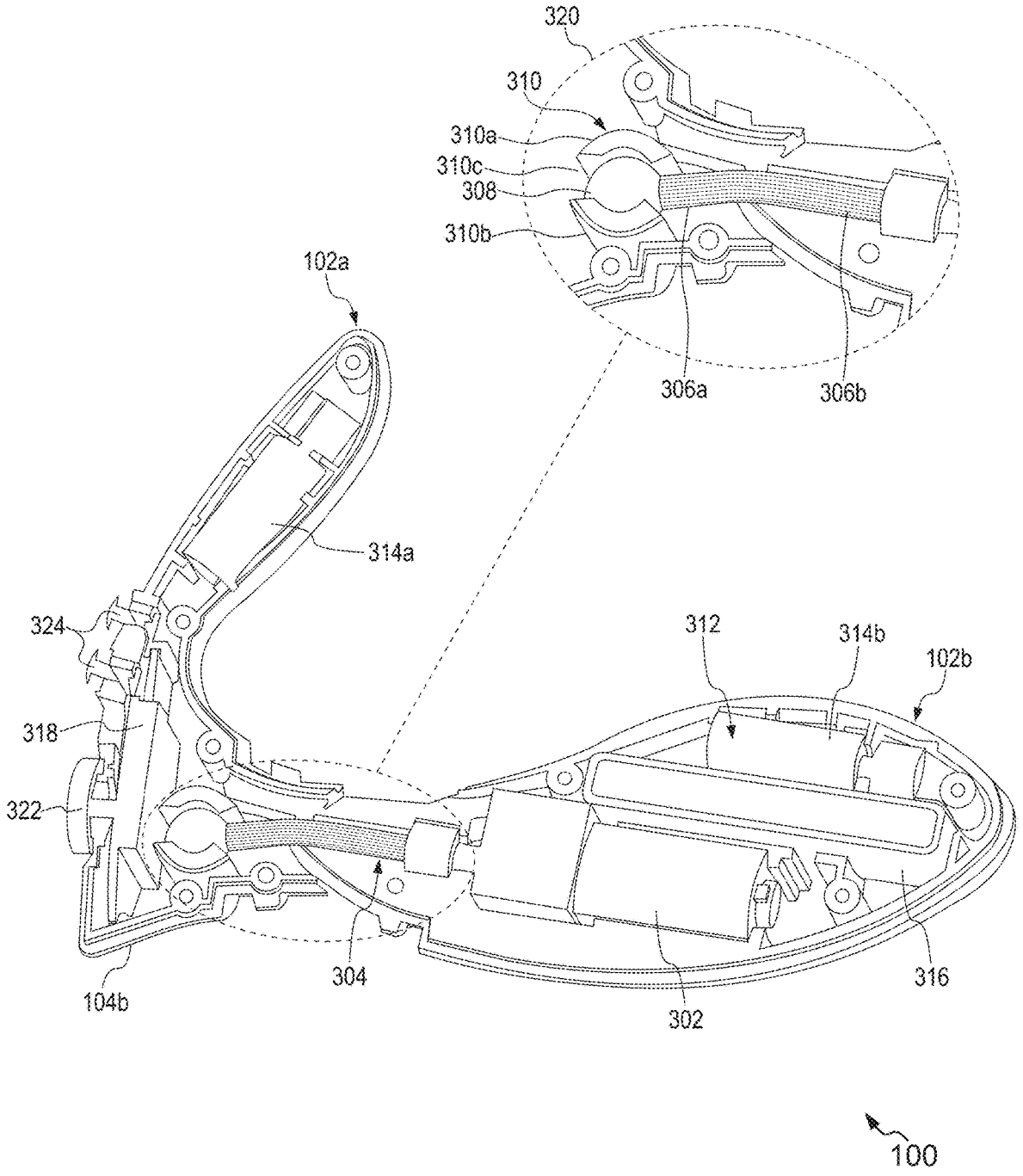
FIG. 3 a schematic representation of the massaging device upon detachment of a second half-shell and a fourth half-shell of the massaging device, in accordance with an embodiment of the present disclosure.

Referring to FIG. 3, a schematic representation of the massaging device 100 upon detachment of the second half-shell 202*b* and the fourth half-shell 204*b* is illustrated. The massaging device 100 includes the actuator 302, and a drive member 304. The actuator 302 is positioned in the second stimulating member 102*b*. The actuator 302 may include at least one motor configured for operating in a plurality of rotating speeds. The drive member 304 is operatively coupled to the actuator 302. Specifically, the drive member 304 includes a first arm 306*a* and a second arm 306*b*. The second arm 306*b* is coupled to the actuator 302 and the first arm 306*a* is coupled to the second arm 306*b*. The first arm 306*a* and the second arm 306*b* are oriented at a predefined angle (see, magnified portion 320 of FIG. 3). Further, the first arm 306*a* includes a retainer member 308. In an embodiment, the retainer member 308 is of a spherical shape. In an embodiment, the retainer member 308 is a rolling ball. Alternatively, the retainer member 308 may be configured in any other geometrical shapes which serve the purpose. The retainer member 308 of the first arm 306*a* is movably secured to a first limiting member 310 configured in the distal portion 104*b* of the first stimulating member 102*a*, thereby coupling the first stimulating member 102*a* with the second stimulating member 102*b*.

More specifically, the first limiting member 310 is a guide groove structure. The guide groove structure is adapted to receive the retainer member 308 of the first arm 306*a* therein. In an embodiment, the guide groove structure may include a top guide rail 310*a*, a bottom guide rail 310*b*, and a space 310*c* defined therebetween. As such, the space 310*c* defined therebetween is configured for receiving the retainer member 308. The first limiting member 310 is configured based at least on the structural configuration and dimensions of the retainer member 308, thereby allowing the retainer member 308 to be movably secured within the first limiting member 310. Further, it is to be noted that the length of the top guide rail 310*a* and the bottom guide rail 310*b* is configured based at least on a lateral displacement of the retainer member 308 driven by the actuator 302 within the first limiting member 310. In operation, the actuator 302 is configured to drive the drive member 304 in a rotary motion. In this scenario, the retainer member 308 coupled to the first arm 306*a* traverses along at least the length of the first limiting member 310 (i.e. guide groove structure) due to the rotary motion of the drive member 304. The lateral displacement of the retainer member 308 within the first limiting member 310 allows at least the first stimulating member 102*a* and the second stimulating member 102*b* to be operated in the plurality of stimulating modes for providing sexual pleasure which will be explained further in detail.

Additionally, the massaging device 100 includes one or more stimulation devices 312 positioned in at least the first stimulating member 102*a* and the second stimulating member 102*b*. The stimulation devices 312 are configured to enhance the stimulation effect of the massaging device 100. In other words, the simulation devices 312 are configured to induce stimulations to walls of the first and second stimulating members 102*a* and 102*b* when the massaging device 100 is used to stimulate the female genitalia. Some non-limiting examples of the stimulation devices 312 are electrically and thermally conductive elements and a vibrating device. In an embodiment, the stimulation devices 312 include a first stimulation device 314*a* and a second stimulation device 314*b*. The first stimulation device 314*a* and the second stimulation device 314*b* are positioned in the first stimulating member 102*a* and the second stimulating member 102*b*, respectively. More specifically, the first stimulation device 314*a* and the second stimulation device 314*b* are positioned in the proximal portion 104*a* and the first portion 106*a* of the first stimulating member 102*a* and the second stimulating member 102*b*, respectively. It is to be noted that the proximal portion 104*a* of the first stimulating member 102*a* and the first portion 106*a* of the second stimulating member 102*b* is the initial point of contact with the female genitals, for example, the clitoris and vaginal area, respectively. To that effect, the first and second stimulation devices 314*a* and 314*b* are positioned in the proximal portion 104*a* and the first portion 106*a*, respectively. Further, the combined effect of the first and second stimulation devices 314*a* and 314*b*, and the first and second stimulating members 102*a* and 102*b* enhances the sexual stimulation of the female genitalia (or erogenous zones).

Further, the massaging device 100 includes a power source 316 for providing electrical power to the one or more components of the massaging device 100. The power source 316 is arranged in the second stimulating member 102*b*. The power source 316 is configured to provide one of an alternating current output or a direct current output. In an embodiment, the power source 316 includes a direct current power source, such as a rechargeable battery (for example, a lithium-ion battery), operable to provide the required electrical power for the operation of the actuator 302, an electronic circuitry (see, 318), the stimulation devices 312, and the like. Further, the power source 316 may include electrical and/or electronic components or circuits for enabling the use of wired or wireless charging. In an embodiment, the massaging device 100 may include a charging port (see, 324 of FIG. 3) for enabling connection with an external power source to recharge the power source 316 (e.g., the rechargeable battery). For example, the charging port 324 may be a magnetic charging port. Alternatively, the massaging device 100 may include a conventional charging port such as, but not limited to, a universal serial bus (USB) port Type-A or USB port Type-B or Micro USB port Type-B. In some embodiments, the power source 316 may include electrical and/or electronic components or circuits for enabling the use of alternating current to provide the required electrical power for the operation of the components such as the actuator 302, the electronic circuitry 318, the stimulation devices 312, and the like.

The electronic circuitry 318 is configured to operate the massaging device 100 in the plurality of stimulation modes. As shown, the electronic circuitry 318 is positioned in the distal portion 104*b* of the first stimulating member 102*a*. The electronic circuitry 318 may include circuitry configured to operate the internal components such as the actuator 302, the stimulation devices 312, etc., of the massaging device 100 for providing sexual stimulation. In particular, the electronic circuitry 318 is configured to operate the massaging device 100 based on operating at least one button 322 of the massaging device 100. The user may provide input on the button 322 for a short duration of time (e.g., 3 sec) to activate and/or deactivate the massaging device 100 (i.e. to switch ON and switch OFF the massaging device 100 or activate and deactivate wireless connectivity of the massaging device 100). Further, the user may provide input on the button 322 for a duration of time (e.g., 1 sec) for adjusting and/or controlling the stimulation devices 312 (e.g., switching different vibration pattern or vibration intensity).

In one scenario, the electronic circuitry 318 may be configured to operate only the first and second stimulating members 102*a* and 102*b*. In another scenario, the electronic circuitry 318 may be configured to operate only the stimulation devices 312. In another scenario, the electronic circuitry 318 may be configured to operate both the first and second stimulating members 102*a* and 102*b*, and the stimulation devices 312 for enhancing the sexual stimulation. The electronic circuitry 318 operating the first and second stimulating members 102*a* and 102*b* in the plurality of stimulation modes and the internal components of the massaging device 100 are explained with reference to FIGS. 4A-5C.

Figure 4A:
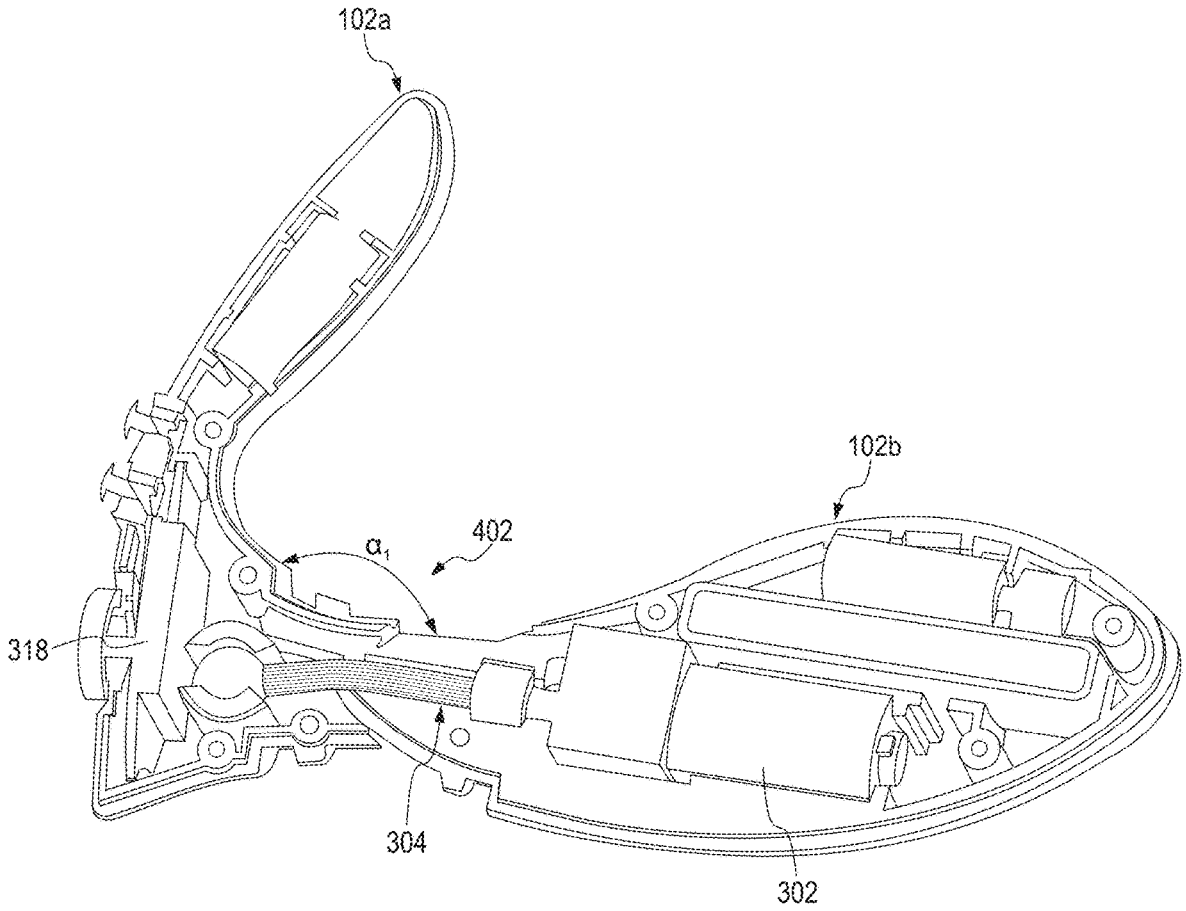
FIGS. 4A, 4B, 4C, and 4D illustrate the articulation of the massaging device in a plurality of stimulation modes, in accordance with an embodiment of the present disclosure.
Figure 4B:
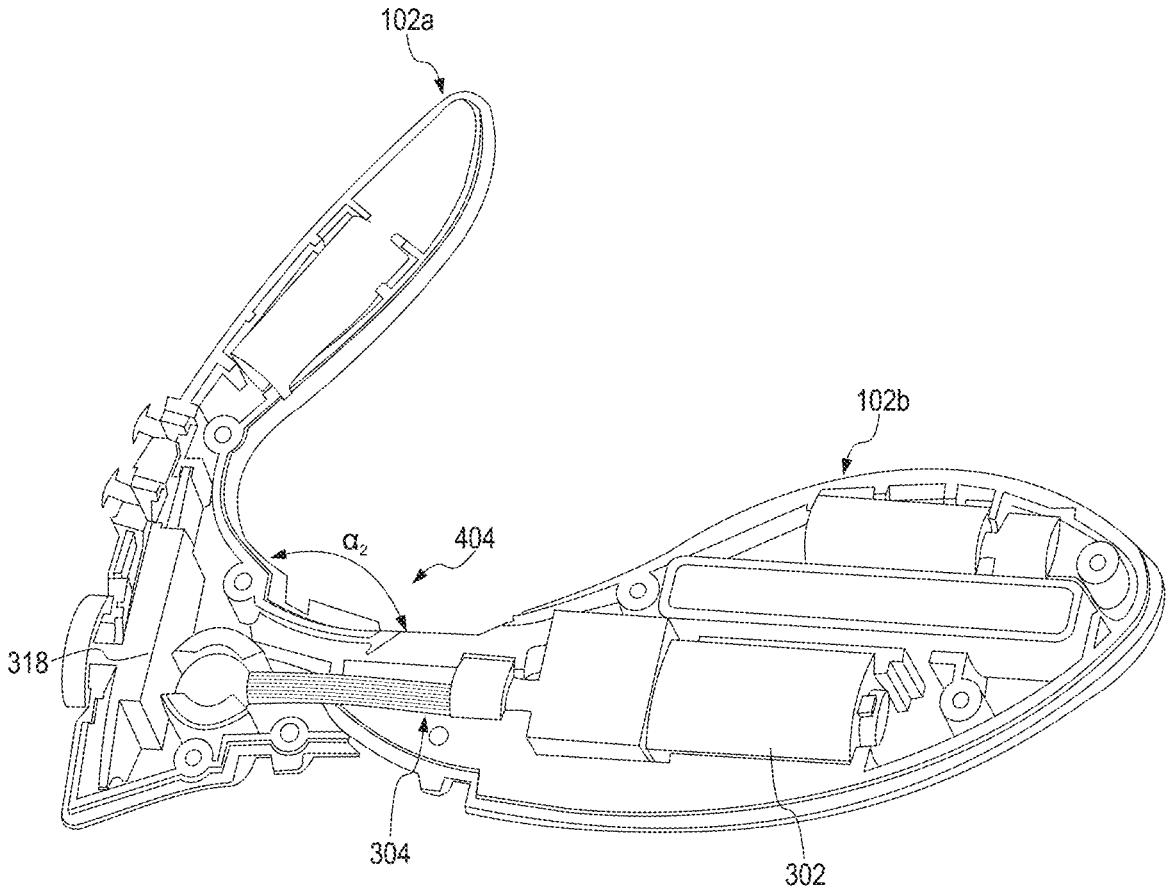

Referring to FIG. 4A, the electronic circuitry 318 is configured to operate the massaging device 100 in a first stimulation mode. More specifically, the electronic circuitry 318 is configured to operate actuator 302 to drive the drive member 304. As such, the rotary motion of the drive member 304 facilitates the retainer member 308 to traverse along at least a length of the guide groove structure (or the first limiting member 310). The lateral displacement of the retainer member 308 in the first limiting member 310 allows at least the first stimulating member 102*a* and the second stimulating member 102*b* to be operated in the first stimulation mode.

Further, in the first stimulation mode, the first stimulating member 102*a* and the second stimulating member 102*b* are operable between a first orientation (see, 402 of FIG. 4A) and a second orientation (see, 404 of FIG. 4B) relative to each other. The user may use the second stimulating member 102*b* to stimulate the vaginal area and the first stimulating member 102*a* to stimulate the clitoris. In this scenario, the second stimulating member 102*b* may be insertable within the vaginal area and the first stimulating member 102*a* may be positioned in contact with the clitoris. As such, the first stimulating member 102*a* and the second stimulating member 102*b* operating between the first orientation (see, 402) and the second orientation (see, 404) simultaneously stimulate the clitoris (or glans region) and the vaginal area of the female user. Further, the first stimulating member 102*a* and the second stimulating member 102*b* are operated in the first orientation 402 based on the first threshold angle (represented by '$\alpha_1$'). In other words, the first stimulating member 102*a* and the second stimulating member 102*b* are operated relative to each other based on the first threshold angle '$\alpha_1$'. The first threshold angle '$\alpha_1$' may correspond to a reference angle i.e. the first stimulating member 102*a* coupled to the second stimulating member 102*b* is oriented based on the first threshold angle '$\alpha_1$' relative to the second stimulating member 102*b*.

Furthermore, the first stimulating member 102*a* and the second stimulating member 102*b* are operated in the second orientation 404 based on a second threshold angle (represented by '$\alpha_2$'). As shown, the first stimulating member 102*a* and the second stimulating member 102*b* are oriented towards each other when the massaging device 100 is operated in the second stimulation mode. The first stimulating member 102*a* and the second stimulating member 102*b* operating between the first threshold angle '$\alpha_1$' and the second threshold angle '$\alpha_2$' produces the sexual pleasure of masturbation. In an example scenario, the user may be lying on bed, bathing in a bathtub, or floating in the pool etc. In this scenario, the user may operate the massaging device 100 including the first stimulating member 102*a* and the second stimulating member 102*b* for simultaneously stimulating the one or more erogenous zone (e.g., clitoris or glans region, and the vaginal area) of the female user as explained above. In other words, the user may operate the massaging device 100 between the first stimulation mode and the second stimulation mode when the user is lying on bed, bathing in a bathtub, or floating in the pool.

Figure 4C:
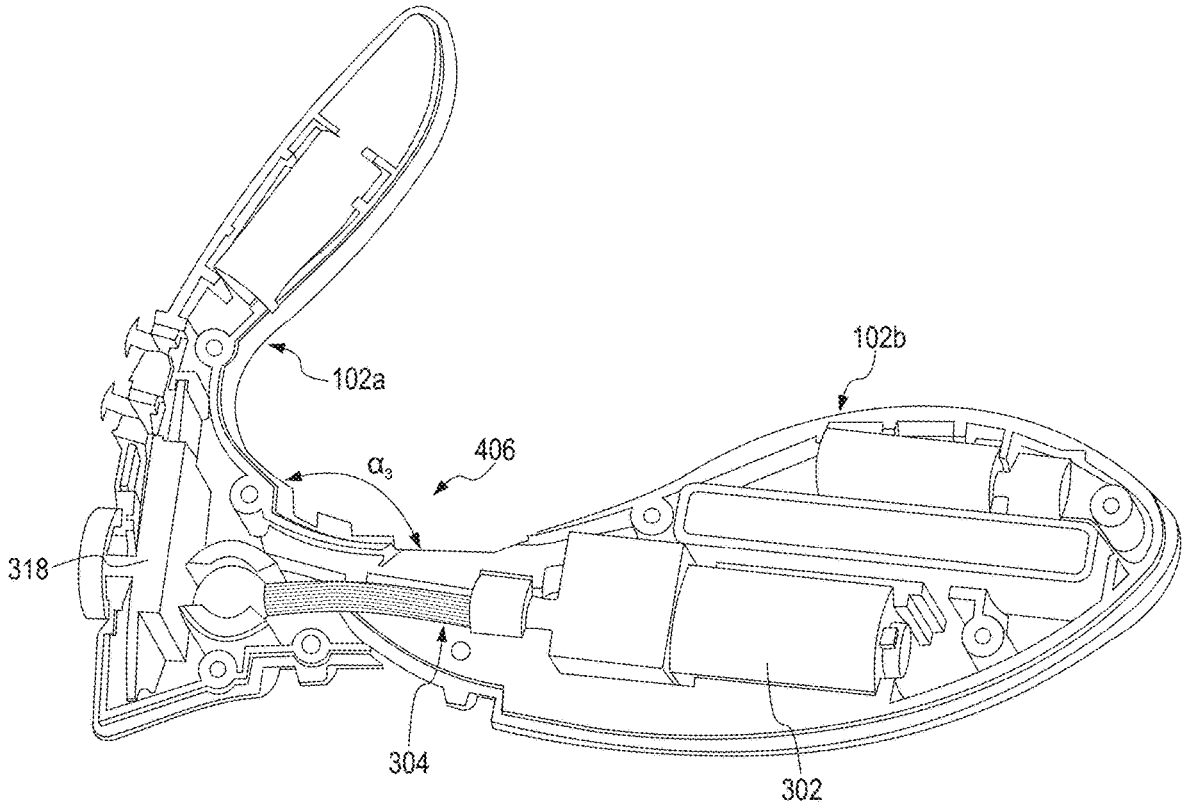

Referring to FIG. 4C, the massaging device 100 is operated in the second stimulation mode. In particular, the second stimulating member 102*b* is operated in a third orientation (see, 406) relative to the first stimulating member 102*a* based on a third threshold angle (represented by '$\alpha_3$'). In this use case, the user may sit on a chair when wearing (or using) the massaging device 100. As such, the movement of the first stimulating member 102*a* is hindered when the massaging device 100 is operated during the use case (i.e. hindered by the chair) as described above. Prior to operating the massaging device 100, the first stimulating member 102*a* may be oriented at the first threshold angle '$\alpha_1$' relative to the second stimulating member 102*b*. As explained above, the rotary motion of the drive member 304 facilitates movement of the first and second stimulating members 102*a* and 102*b*. However, the movement of the first stimulating member 102*a* is opposed (or hindered) due to the force applied by the chair during use. To that effect, the second stimulating member 102*b* is configured to move towards the first stimulating member 102*a*, thus resulting in the third orientation 406. In other words, the first stimulating member 102*a* and the second stimulating member 102*b* are operated between the first orientation 402 (or the first threshold angle '$\alpha_1$') and the third orientation 406 (or the third threshold angle '$\alpha_3$'). It is to be understood that the third threshold angle '$\alpha_3$' is greater than the second threshold angle '$\alpha_2$'. Further, the massaging device 100 operating in the third orientation 406 may stimulate the vaginal area or G-spot stimulation.

Figure 4D:
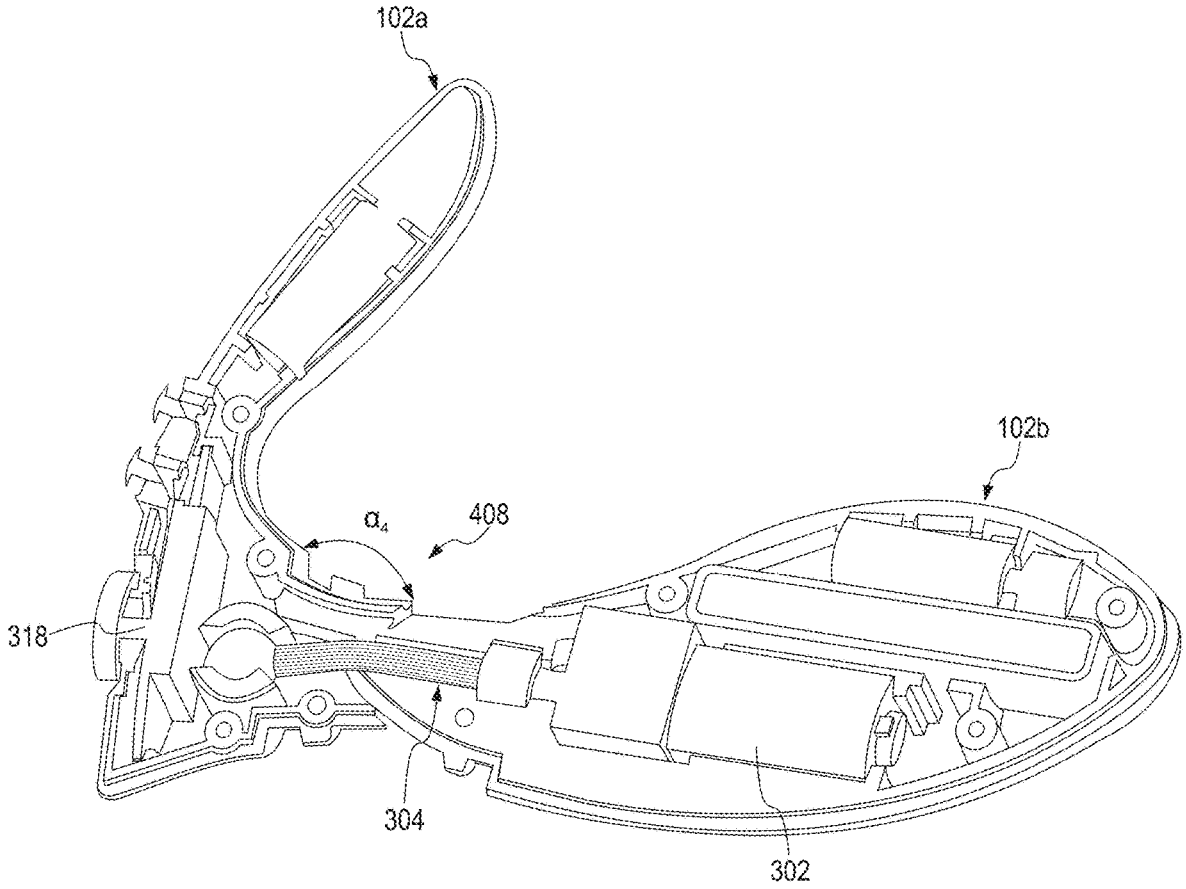

Referring to FIG. 4D, the massaging device 100 is operated in the third stimulation mode. In particular, the first stimulating member 102*a* is operated in a fourth orientation (see, 408) relative to the first stimulating member 102*a* based on a fourth threshold angle (represented by '$\alpha_4$'). In this scenario, the user may stand or walk when wearing (i.e. the second stimulating member 102*b* being inserted into the vaginal area of the user) the massaging device 100, which hinders the movement of the second stimulating member 102*b* when the massaging device 100 is operated. Prior to operating the massaging device 100, the second stimulating member 102*b* may be oriented at the first threshold angle '$\alpha_1$' relative to the first stimulating member 102*a*. As explained above, the rotary motion of the drive member 304 facilitates movement of the first and second stimulating members 102*a* and 102*b*. However, the movement of the second stimulating member 102*b* is opposed due to the force applied by the contraction of the user's vagina during use (or when the user is standing). To that effect, the first stimulating member 102*a* is configured to move towards the second stimulating member 102*b*, thus resulting in the fourth orientation 408. In other words, the first stimulating member 102*a* and the second stimulating member 102*b* are operated between the first orientation 402 (or the first threshold angle '$\alpha_1$') and the fourth orientation 408 (or the fourth threshold angle '$\alpha_4$'). In an embodiment, the third threshold angle '$\alpha_3$' may be equivalent to the fourth threshold angle '$\alpha_4$' as the second stimulating member 102*b* and the first stimulating member 102*a* are fixed in the third orientation 406 and the fourth orientation 408, respectively. Further, the massaging device 100 operating in the fourth orientation 408 may stimulate the clitoris.

Figure 5A:
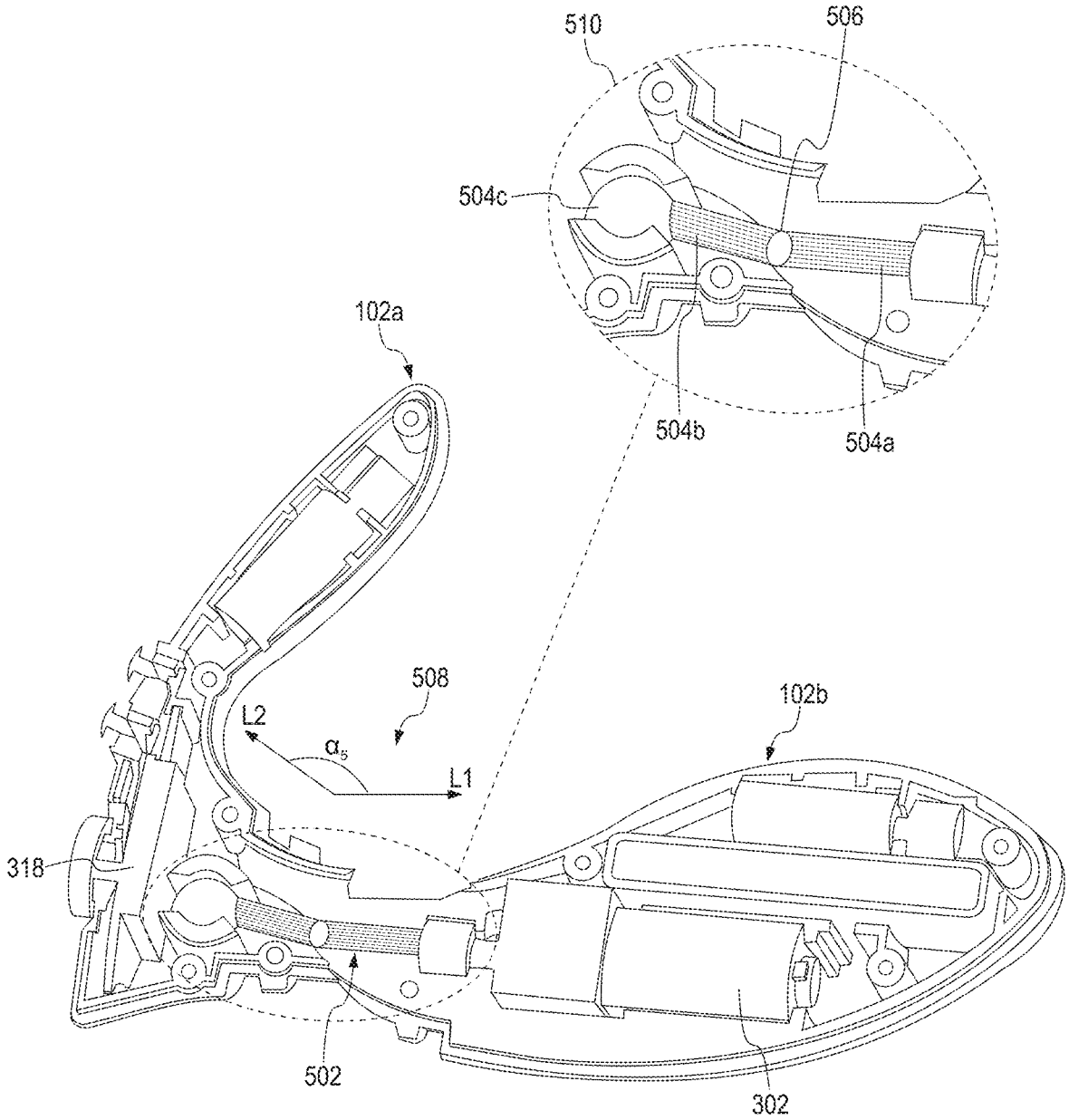
FIGS. 5A, 5B, and 5C illustrate the articulation of the massaging device in a plurality of stimulation modes, in accordance with another embodiment of the present disclosure.

Referring to FIG. 5A, the massaging device 100 including a drive member 502 of a different configuration is shown. The drive member 502 may be configured with materials (e.g., shape memory metals) that are capable of operating in deformed configuration and pre-deformed configuration. In other words, the drive member 502 may be made of resilient materials i.e. the materials that can be deformed by external force and can revert to their original shape when the external force is released. The drive member 502 includes a first arm 504*a*, a second arm 504*b*, and a retainer member 504*c*. In an embodiment, the retainer member 504*c* is coupled to the second arm 504*b* and secured to the first limiting member 310. In another embodiment, the retainer member 504*c* may be fixed in the first limiting member 310, such that the first arm 504*a*, the retainer member 504*c* fixed in the first limiting member 310, and the second stimulating member 102*b* are static relatively and move together (i.e. operate in the plurality of stimulation modes).

Figure 5B:
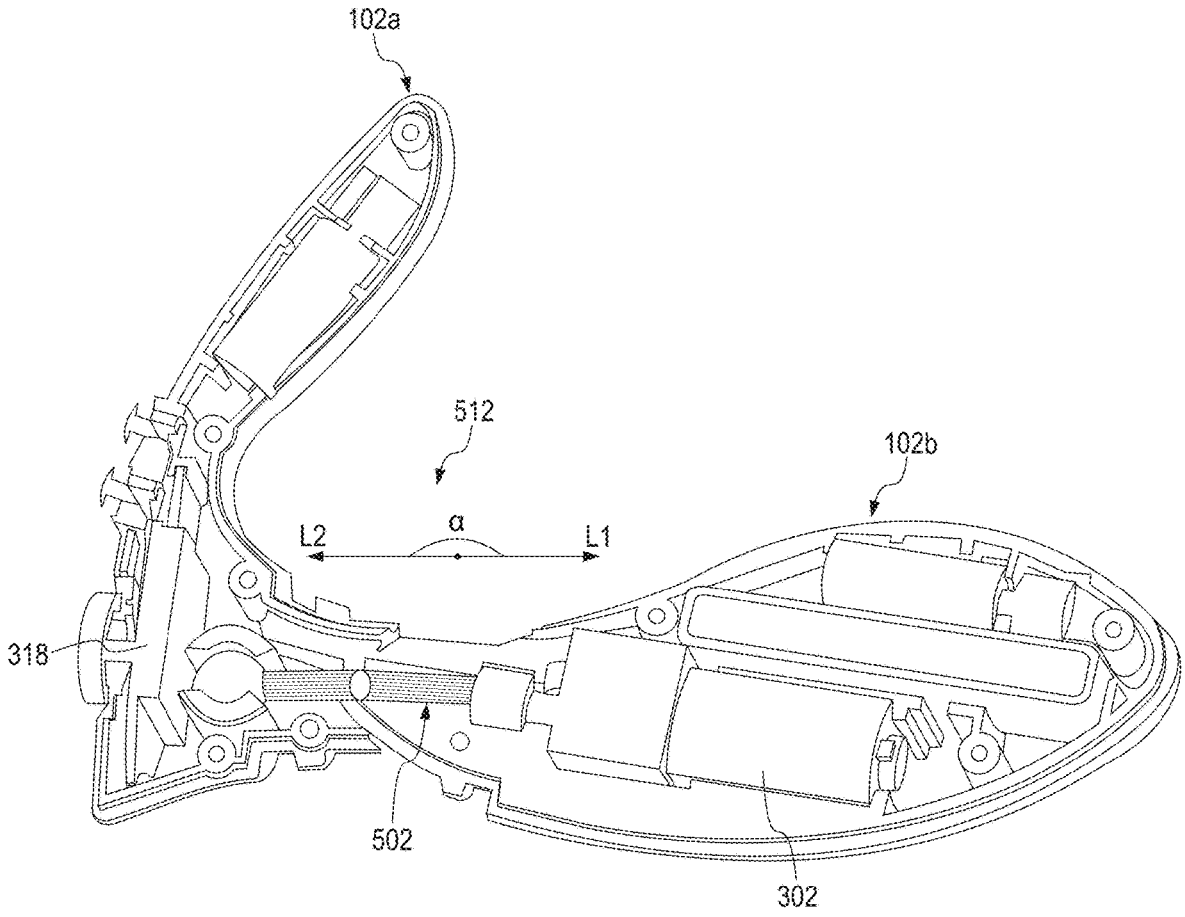
Figure 5C:
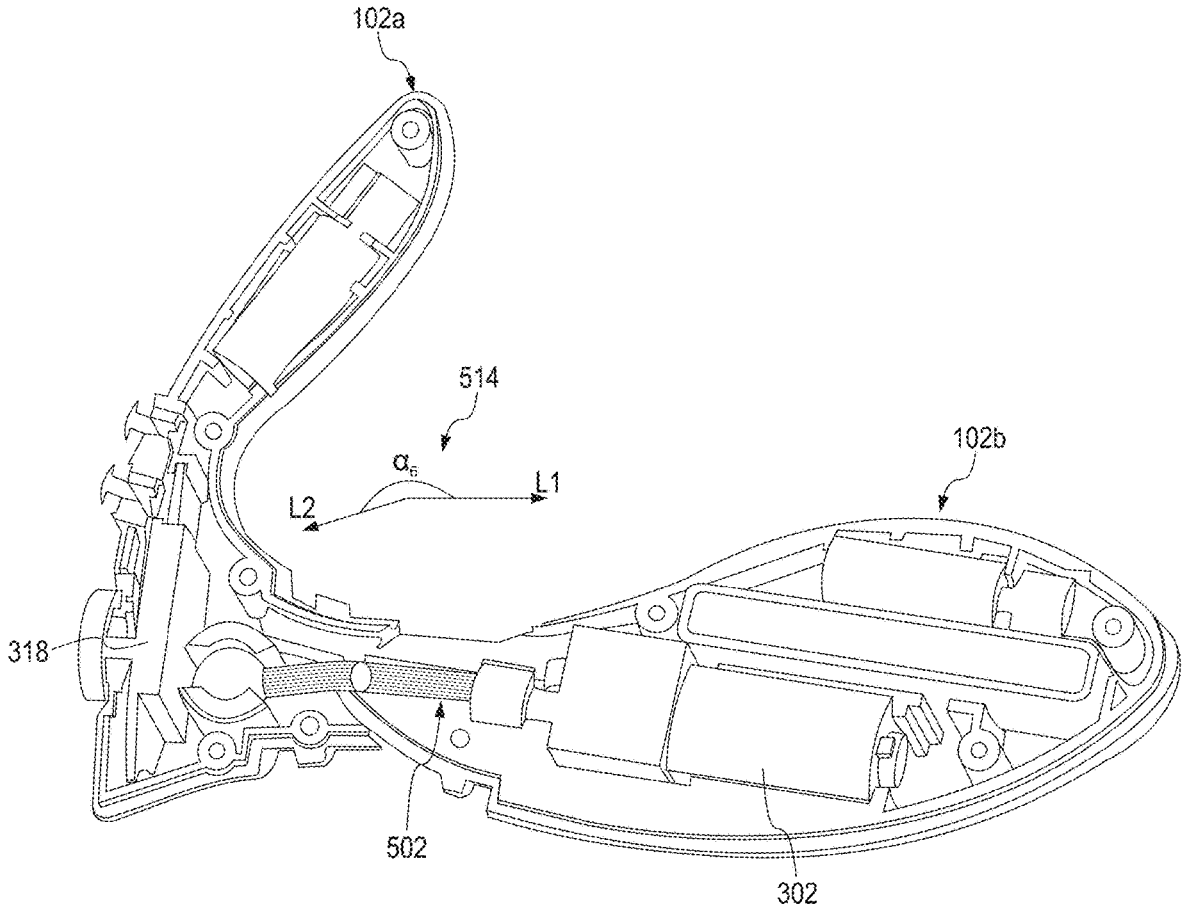

Further, the first arm 504*a* is pivotally coupled to the second arm 504*b* via a coupling member 506. It is to be noted that the coupling member 506 is configured to convert the rotary motion of the first arm 504*a* relative to the actuator 302 into an oscillatory motion, thus enabling the second arm 504*b* to oscillate between a first position (see, 508 in magnified portion 510 of FIG. 5A) and a second position (see, 514 of FIG. 5C). More specifically, the coupling member 506 is configured with a groove (not shown in figures) for allowing the second arm 504*b* to move only in a longitudinal direction (as shown in FIGS. 5A-5C). As a result, the second arm 504*b* is configured to be operable between a fifth threshold angle '$\alpha_5$' (e.g., 170 degrees) and a sixth threshold angle '$\alpha_6$' (e.g., 190 degrees) as explained with references to FIGS. 5A-5C. For illustration purposes, the fifth threshold angle 'as' between the first arm 504*a* and the second arm 504*b* is depicted using the angle between the lines L1 and L2, where the lines L1 and L2 represent the first arm 504*a* and the second arm 504*b*, respectively.

Referring to FIG. 5B, the second arm 504*b* may be oriented at a reference angle '$\alpha$' of 180 degrees for each quarter rotation. In one scenario, the first arm 504*a* of the drive member 504 rotates, for example, one-quarter of a full circle (i.e. from 0 to $\frac{1}{4}^{th}$ of 360 degrees). In this scenario, the second arm 504*b* will attain a reference position (see, 512 of FIG. 5B) from the first position 508. In other words, the second arm 504*b* will be operable between the fifth threshold angle '$\alpha_5$' (e.g., 170 degrees) and the reference angle '$\alpha$' (e.g., 180 degrees). For illustration purposes, the reference angle '$\alpha$' and the fifth threshold angle '$\alpha_5$' between the first arm 504*a* and the second arm 504*b* are depicted as the angle between the lines L1 and L2.

In another scenario, the first arm 504*a* of the drive member 504 rotates, for example, one quarter to the second quarter of a full circle (i.e. $\frac{1}{4}^{th}$ to ½ of 360 degrees). In this scenario, the second arm 504*b* will attain the third position (see, 514 of FIG. 5C) from the reference position (see, 512 of FIG. 5B) i.e. the second arm 504*b* will operate between the reference angle '$\alpha$' (e.g., 180 degrees) and the sixth threshold angle '$\alpha_6$' (e.g., 190 degrees). For illustration purposes, the sixth threshold angle '$\alpha_6$' between the first arm 504*a* and the second arm 504*b* is depicted as the angle between the lines L1 and L2.

In another scenario, the first arm 504*a* of the drive member 504 rotates, for example, the second quarter to the third quarter of a full circle (i.e. $\frac{1}{2}^{th}$ to $\frac{3}{4}^{th}$ of 360 degrees). In this scenario, the second arm 504*b* will attain the reference position (see, 512 of FIG. 5B) from the third position (see, 514 of FIG. 5C) i.e. the second arm 504*b* will operate between the sixth threshold angle '$\alpha_6$' (e.g., 190 degrees) and the reference angle '$\alpha$' (e.g., 180 degrees).

In another scenario, the first arm 504*a* of the drive member 504 rotates, for example, the third quarter to the fourth quarter of a full circle (i.e. $\frac{3}{4}^{th}$ to 4/4 of 360 degrees or full circle). In this scenario, the second arm 504*b* will attain the first position (see, 508 of FIG. 5A) from the reference position (see, 512 of FIG. 5B) i.e. the second arm 504*b* will operate between the reference angle '$\alpha$' (e.g., 180 degrees) and the fifth threshold angle '$\alpha_5$' (e.g., 170 degrees).

Further, the oscillatory motion of the second arm 504*b* facilitates at least the first stimulating member 102*a* and the second stimulating member 102*b* to operate in at least one of the first stimulation mode, the second stimulation mode, and the third stimulation mode. It should be understood that the operation of the massaging device 100 due to the configuration of the drive member 502 is similar to the operation of the massaging device 100 including the drive member 304. Therefore, the operations and/or functionality of the massaging device 100 including the drive member 502 are not explained in detail for the sake of brevity.

In an embodiment, the massaging device 100 may be configured to include a control knob (not shown in Figures) to receive input related to the rotational speed of the actuator 302. The electronic circuitry 318 may be configured to control the rotational speed of the actuator 302 to regulate the stimulation induced by the operation of the first and second stimulating members 102*a* and 102*b* in the plurality of stimulation modes based on the adjustment of the control knob by the user. In another embodiment, the massaging device 100 may be configured to control the level of stimulation induced by the stimulation devices 312. In another embodiment, the massaging device 100 may include sensory feedback (not shown in figures) for monitoring the user behavior during the sexual stimulation.

The massaging device 100 of the present disclosure provides several advantages or benefits to the user. Particularly, the massaging device 100 of the present disclosure provides a hands-free, wearable experience to the user. Moreover, the massaging device 100 is self-powered and its features (i.e. hands-free and wearable features) provide a satisfying sexual pleasure to the user during use. Additionally, the massaging device 100 may be utilized for general therapeutic use.

Various embodiments of the disclosure, as discussed above, may be practiced with steps and/or operations in a different order, and/or with hardware elements in configurations, which are different than those which are disclosed. Therefore, although the disclosure has been described based upon these exemplary embodiments, it is noted that certain modifications, variations, and alternative constructions may be apparent and well within the scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A massaging device, comprising:

a first stimulating member;

a second stimulating member comprising a drive member, the drive member comprising a first arm configured with a retainer member and a second arm;

wherein the retainer member of the first arm is secured to a first limiting member configured in the first stimulating member, thereby enabling a coupling between the first stimulating member and the second stimulating member; and an actuator positioned in the second stimulating member and operatively coupled to the drive member, the actuator configured to induce a rotary motion to the drive member for operating at least one of the first stimulating member and the second stimulating member in a plurality of stimulation modes, wherein the first stimulating member and the second stimulating member are adapted to be in contact with one or more erogenous zones of a user and are adapted to be operable in the plurality of stimulation modes to induce sexual stimulation to the one or more erogenous zones of the user;

wherein the first arm is oriented at a predefined angle relative to the second arm, and wherein the predefined angle between the first arm and the second arm facilitates the first and second stimulating members to operate between a first threshold angle and a second threshold angle while the drive member is operated in the rotary motion.

2. The massaging device as claimed in claim 1, wherein the plurality of stimulation modes comprises a first stimulation mode, a second stimulation mode, and a third stimulation mode.

3. The massaging device as claimed in claim 2, wherein, in the first stimulation mode, the first stimulating member and the second stimulating member are operable between a first orientation and a second orientation relative to each other based on the first threshold angle and the second threshold angle, respectively, in the second stimulation mode, the second stimulating member is operated in a third orientation relative to the first stimulating member based on a third threshold angle, and in the third stimulation mode, the first stimulating member is operated in a fourth orientation relative to the second stimulating member based on a fourth threshold angle.

4. The massaging device as claimed in claim 1, wherein the first stimulating member and the second stimulating member coupled to each other substantially forms at least one of a V-shaped configuration and an L-shaped configuration.

5. The massaging device as claimed in claim 1, wherein the first limiting member is a guide groove structure configured in a distal portion of the first stimulating member and adapted to movably receive the retainer member of the first arm therein, and wherein the retainer member traverses along at least a length of the guide groove structure while the drive member is rotating, thereby allowing at least the first stimulating member and the second stimulating member to be operated in the plurality of stimulating modes.

6. The massaging device as claimed in claim 5, wherein the guide groove structure comprises a top guide rail, a bottom guide rail, and a space defined therebetween for receiving the retainer member, and wherein a length of the top guide rail and the bottom guide rail is configured based at least on a lateral displacement of the retainer member driven by the actuator within the guide groove structure.

7. The massaging device as claimed in claim 1, wherein the first arm is pivotally coupled to the second arm via a coupling member, the coupling member configured to convert the rotary motion of the first arm relative to the actuator into an oscillatory motion, thus enabling the second arm to oscillate between a first position and a second position, and wherein the oscillatory motion of the second arm facilitates at least the first stimulating member and the second stimulating member to operate in at least one of a first stimulation mode, a second stimulation mode, and a third stimulation mode.

8. The massaging device as claimed in claim 1, wherein the first stimulating member is adapted to be placed outside the user's body and be in contact with a glans region of the one or more erogenous zones, and the second stimulating member is adapted to be insertable at least within a vaginal area and a prostate region of the one or more erogenous zones.

9. The massaging device as claimed in claim 8, wherein the first stimulating member and the second stimulating member operated in the plurality of stimulation modes are configured to stimulate the glans region, and at least one of the vaginal area and the prostate region of the user, respectively.

10. The massaging device as claimed in claim 1, further comprising a silicon sleeve adapted to be insertable onto the first stimulating member and the second stimulating member.

11. The massaging device as claimed in claim 1, further comprising one or more stimulation devices positioned in at least one of the first stimulating member and the second stimulating member, the one or more stimulation devices configured to stimulate a genitalia of the user.

12. The massaging device as claimed in claim 1, further comprising an electronic circuitry housed within the second stimulating member, the electronic circuitry configured to at least control an operating speed of the actuator and facilitate wireless communication with a user device associated with the user for operating the massaging device based on providing user inputs in the user device.

13. A massaging device for inducing sexual stimulation, the massaging device comprising:

a first stimulating member;

a second stimulating member comprising a drive member, the drive member comprising a first arm configured with a retainer member and a second arm, wherein the retainer member of the first arm is movably secured to a first limiting member configured in a distal portion of the first stimulating member, and wherein the first limiting member is a guide groove structure adapted to receive the retainer member, thus enabling a coupling between the first stimulating member and the second stimulating member; and an actuator positioned in the second stimulating member and operatively coupled to the drive member, wherein the actuator is configured to induce a rotary motion to the drive member, wherein the rotary motion of the drive member allows the retainer member to traverse along at least a length of the first limiting member, thereby allowing at least the first stimulating member and the second stimulating member in a plurality of stimulation modes, and wherein the first stimulating member and the second stimulating member are adapted to be in contact with one or more erogenous zones of a user and are adapted to be operable in the plurality of stimulation modes to induce sexual stimulation to the one or more erogenous zones of the user.

14. The massaging device as claimed in claim 13, wherein the plurality of stimulation modes comprises a first stimulation mode, a second stimulation mode, and a third stimulation mode, wherein, in the first stimulation mode, the first stimulating member and the second stimulating member are operable between a first orientation and a second orientation relative to each other based on a first threshold angle and a second threshold angle, respectively, in the second stimulation mode, the second stimulating member is operated in a third orientation relative to the first stimulating member based on a third threshold angle, and in the third stimulation mode, the first stimulating member is operated in a fourth orientation relative to the second stimulating member based on a fourth threshold angle, wherein the first and second stimulating members operable in the plurality of stimulation modes are configured to provide sexual stimulation to the one or more erogenous zones of the user.

15. The massaging device as claimed in claim 13, wherein the first arm is oriented at a predefined angle relative to the second arm, and wherein the predefined angle between the first arm and the second arm facilitates the first and second stimulating members to operate between a first threshold angle and a second threshold angle while the drive member is operated in the rotary motion.

16. The massaging device as claimed in claim 13, wherein the guide groove structure comprises a top guide rail, a bottom guide rail, and a space defined there between for receiving the retainer member, and wherein a length of the top guide rail and the bottom guide rail is configured based at least on a lateral displacement of the retainer member driven by the actuator within the guide groove structure.

17. The massaging device as claimed in claim 13, wherein the first stimulating member is adapted to be placed outside the user's body and be in contact with a glans region of the one or more erogenous zones, and the second stimulating member is adapted to be insertable at least within a vaginal area and a prostate region of the one or more erogenous zones, and wherein the first stimulating member and the second stimulating member operated in the plurality of stimulation modes are configured to stimulate the glans region, and at least one of the vaginal area and the prostate region of the user, respectively.

18. The massaging device as claimed in claim 13, further comprising one or more stimulation devices positioned in at least the first stimulating member and the second stimulating member, the one or more stimulation devices configured to stimulate a genitalia of the user.

19. The massaging device as claimed in claim 13, further comprising an electronic circuitry housed within the second stimulating member, the electronic circuitry configured to at least control an operating speed of the actuator and facilitate wireless communication with a user device associated with the user for operating the massaging device based on providing user inputs in the user device.

* * * * *